US012595970B2

(12) United States Patent
Lee et al.

(10) Patent No.: US 12,595,970 B2
(45) Date of Patent: Apr. 7, 2026

(54) HEAT EXCHANGER

(71) Applicant: Delta Electronics, Inc., Taoyuan City (TW)

(72) Inventors: Wu-Chi Lee, Taoyuan City (TW); Jyun-Yao Chen, Taoyuan City (TW)

(73) Assignee: Delta Electronics, Inc., Taoyuan City (TW)

( * ) Notice: Subject to any disclaimer, the term of this patent is extended or adjusted under 35 U.S.C. 154(b) by 206 days.

(21) Appl. No.: 18/456,230

(22) Filed: Aug. 25, 2023

(65) Prior Publication Data

US 2024/0125558 A1 Apr. 18, 2024

(30) Foreign Application Priority Data

Oct. 13, 2022 (CN) ..... 202222702052.6

(51) Int. Cl.
*F28D 15/02* (2006.01)

(52) U.S. Cl.
CPC ..... *F28D 15/02* (2013.01)

(58) Field of Classification Search
CPC ..... H05K 7/20609; H05K 7/206
See application file for complete search history.

(56) References Cited

U.S. PATENT DOCUMENTS 4,840,225 A * 6/1989 Foley ..... H05K 7/206 165/104.34
10,185,357 B2 1/2019 Kanbayashi et al.
2012/0291990 A1* 11/2012 Lin ..... H05K 7/206 165/67
2013/0223827 A1 8/2013 Enomoto et al.

FOREIGN PATENT DOCUMENTS

CN 102607304 A * 7/2012 ..... F28D 15/0275
TW 489929 6/2002
TW 496457 7/2002

* cited by examiner

*Primary Examiner* — Jianying C Atkisson
*Assistant Examiner* — Khaled Ahmed Ali Al Samiri
(74) *Attorney, Agent, or Firm* — Muncy, Geissler, Olds & Lowe, P.C.

(57) ABSTRACT

A heat exchanger is provided, including a first case, a second case, a substrate, an engaging structure, an evaporator, a condenser, a first tube, and a second tube. The first case includes a first plate structure and a first protruding structure. The first plate structure has a first inner surface. The first protruding structure protrudes from the first inner surface. The second case includes a second plate structure and a second protruding structure. The second plate structure has a second inner surface. The second protruding structure protrudes from the second inner surface. The substrate is engaged with the first inner surface, the first protruding structure, the second inner surface, and the second protruding structure via the engaging structure. The substrate is in contact with at least three different lateral surfaces of the engaging structure so that the substrate and the first case combine are bonded.

8 Claims, 6 Drawing Sheets

HEAT EXCHANGER

CROSS REFERENCE TO RELATED APPLICATIONS

The present application claims priority of China Utility Model Application No. 202222702052.6, filed Oct. 13, 2022, which is incorporated by reference herein in its entirety.

BACKGROUND OF THE INVENTION

Field of the Invention

The application relates in general to a heat exchanger, and in particular, to a heat exchanger including an evaporator and a condenser.

Description of the Related Art

The computing capabilities and processing power of computers, servers, storage devices and network communication equipment are increasing due to the rapid development of computer technology and the Internet. The aforementioned devices are often installed in cabinets and operate continuously for long periods of time, particularly in data centers. To prevent the devices in the cabinets from overheating, and thereby causing their performance to suffer, and perhaps even to malfunction, a heat dissipating device such as a heat exchanger must be installed to maintain, adjust, or reduce the ambient temperature in such a machine room.

However, in current heat exchangers, the division plate that separates the indoor side from the outdoor side are usually affixed by welding or adhesive bonding. The aforementioned method usually causes a gap to be formed between the indoor side and the outdoor side, reducing the heat exchange efficiency accordingly. Therefore, how to address the aforementioned problem has become an important issue.

BRIEF SUMMARY OF INVENTION

To address the deficiencies of conventional products, an embodiment of the invention provides a heat exchanger, including a first case, a second case, a substrate, an engaging structure, an evaporator, a condenser, a first tube, and a second tube. The first case includes a first plate structure and a first protruding structure. The first plate structure has a first inner surface. The first protruding structure protrudes from the first inner surface. The second case includes a second plate structure and a second protruding structure. The second plate structure has a second inner surface. The second protruding structure protrudes from the second inner surface. The substrate is disposed between the first case and the second case and corresponds to the first protruding structure and the second protruding structure. The substrate is engaged with the first inner surface, the first protruding structure, the second inner surface, and the second protruding structure via the engaging structure. The substrate is in contact with at least three different lateral surfaces of the engaging structure so that the substrate and the first case combine are bonded. The evaporator and the condenser are disposed on the substrate, and the substrate is disposed between the evaporator and the condenser. The evaporator has a first inlet structure and a first outlet structure, and the condenser has a second inlet structure and a second outlet structure. The first tube is connected to the first inlet structure and the second outlet structure. The second tube is connected to the first outlet structure and second inlet structure.

In some embodiments, the substrate comprises a plate, a first extending portion, and a second extending portion. The plate has a first side and a second side opposite the first side. The first extending portion is connected to the first side, and extending in a direction away from the first side. The second extending portion is connected to the second side, and extending in a direction away from the second side. A part of the engaging structure is disposed between the first extending portion and the first inner surface, and another part of the engaging structure is disposed between the second extending portion and the second inner surface.

In some embodiments, the plate has a first surface and a second surface, the first extending portion protrudes from the first surface, the second surface is opposite the first surface and faces the first protruding structure, and a part of the engaging structure is disposed between the second surface and the first protruding structure.

In some embodiments, the first extending portion is disposed between the first protruding structure and the first inner surface. The engaging structure surrounds the first extending portion.

In some embodiments, the first extending portion and the second extending portion extend in the same direction.

In some embodiments, the engaging structure comprises a waterproof glue.

In some embodiments, the first plate structure and the first protruding structure are integrally formed as one piece, and the second plate structure and the second protruding structure are integrally formed as one piece.

In some embodiments, the substrate is in contact with at least three different lateral surfaces of the engaging structure so that the substrate and the second case combine are bonded.

An embodiment of the invention also provides a heat exchanger, including a first case, a second case, a substrate, an engaging structure, an evaporator, a condenser, a first tube, and a second tube. The first case includes a first recess, and the second case includes a second recess. The substrate is situated between the first case and the second case, and accommodated in the first recess and the second recess. The engaging structure is connected to the substrate and the inner wall of the first recess and the inner wall of the second recess. The substrate is in contact with at least three different lateral surfaces of the engaging structure so that the substrate and the first case combine are bonded. The evaporator and the condenser are disposed on the substrate, and the substrate is disposed between the evaporator and the condenser. The evaporator has a first inlet structure and a first outlet structure, and the condenser has a second inlet structure and a second outlet structure. The first tube is connected to the first inlet structure and the second outlet structure. The second tube is connected to the first outlet structure and second inlet structure.

In some embodiments, the substrate has a first surface, a second surface, and a side surface, the first surface is opposite the second surface, and the side surface is connected to the first surface and the second surface, wherein the engaging structure is accommodated in the first recess and in contact with the first surface, the second surface, and the side surface.

In some embodiments, the engaging structure comprises a waterproof glue.

In some embodiments, the substrate is in contact with at least three different lateral surfaces of the engaging structure so that the substrate and the second case combine are bonded.

An embodiment of the invention further provides a heat exchanger, including a first case, a second case, a substrate, an engaging structure, an evaporator, a condenser, a first tube, and a second tube. The first case includes a plate structure and a protruding structure. The plate structure has an inner surface, and the protruding structure protrudes from the inner surface. The second case includes a recess. The substrate is disposed between the first case and the second case and corresponds to the protruding structure and the recess. The substrate is engaged with the inner surface, the protruding structure, and the inner wall of the recess via the engaging structure. The substrate is in contact with at least three different lateral surfaces of the engaging structure so that the substrate and the first case combine are bonded. The evaporator and the condenser are disposed on the substrate, and the substrate is disposed between the evaporator and the condenser. The evaporator has a first inlet structure and a first outlet structure, and the condenser has a second inlet structure and a second outlet structure. The first tube is connected to the first inlet structure and the second outlet structure. The second tube is connected to the first outlet structure and second inlet structure.

In some embodiments, the substrate comprises a plate and an extending portion, the extending portion is connected to a side of the plate and extended in a direction away from the plate, and a part of the engaging structure is disposed between the extending portion and the inner surface.

In some embodiments, the plate has a first surface and a second surface, the extending portion protrudes from the first surface, the second surface is opposite the first surface and faces the protruding structure, and another part of the engaging structure is disposed between the second surface and the protruding structure.

In some embodiments, the extending portion is disposed between the protruding structure and the inner surface.

In some embodiments, the engaging structure surrounds the extending portion.

In some embodiments, the substrate has a first surface, a second surface, and a side surface, the first surface is opposite the second surface, and the side surface is connected to the first surface and the second surface, wherein the engaging structure is accommodated in the recess and in contact with the first surface, the second surface, and the side surface.

In some embodiments, the engaging structure comprises a waterproof glue.

In some embodiments, the substrate is in contact with at least three different lateral surfaces of the engaging structure so that the substrate and the second case combine are bonded.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the heat exchanger are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
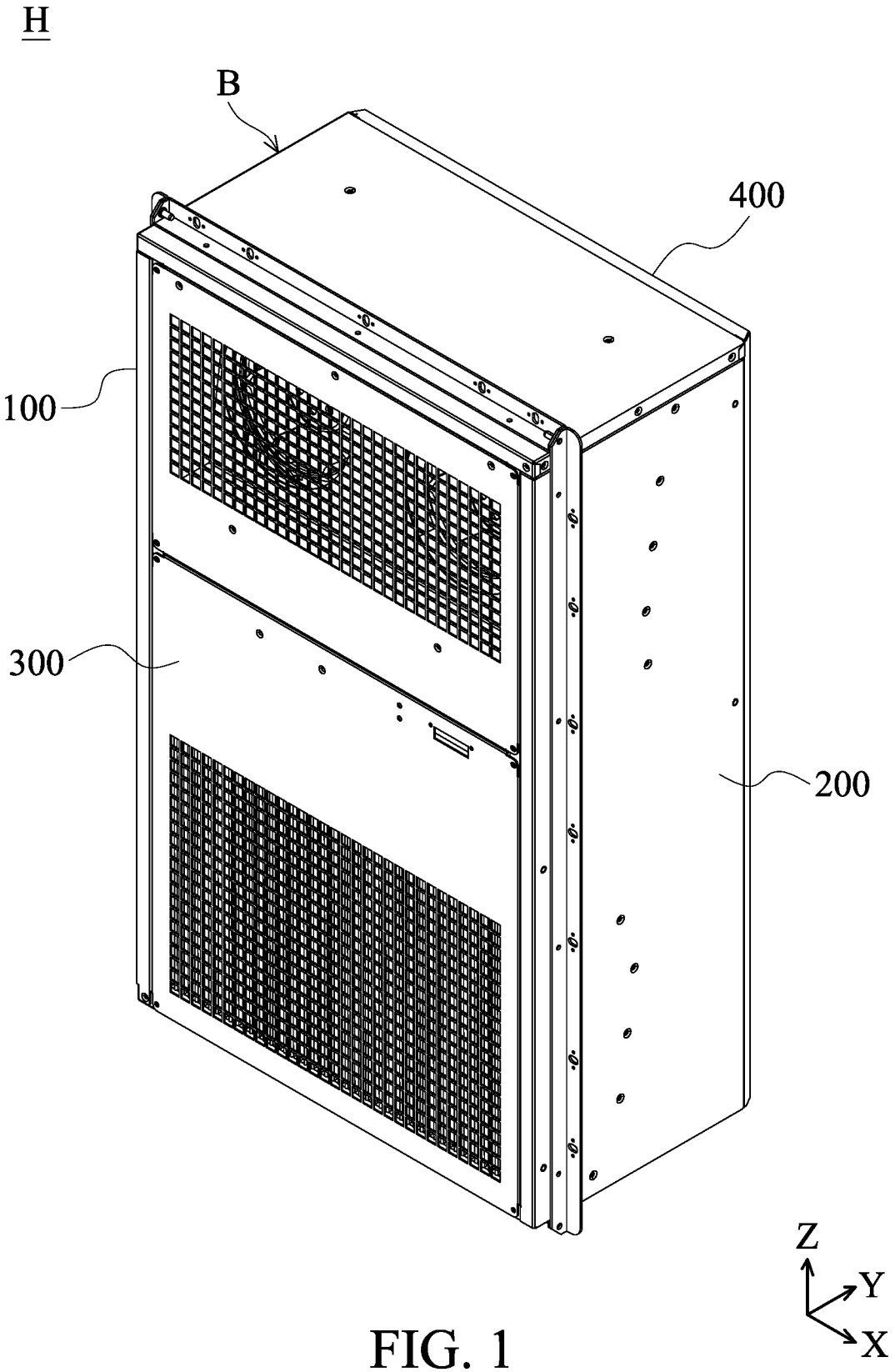
FIG. 1 is a schematic diagram of a heat exchanger according to an embodiment of the invention.
Figure 2:
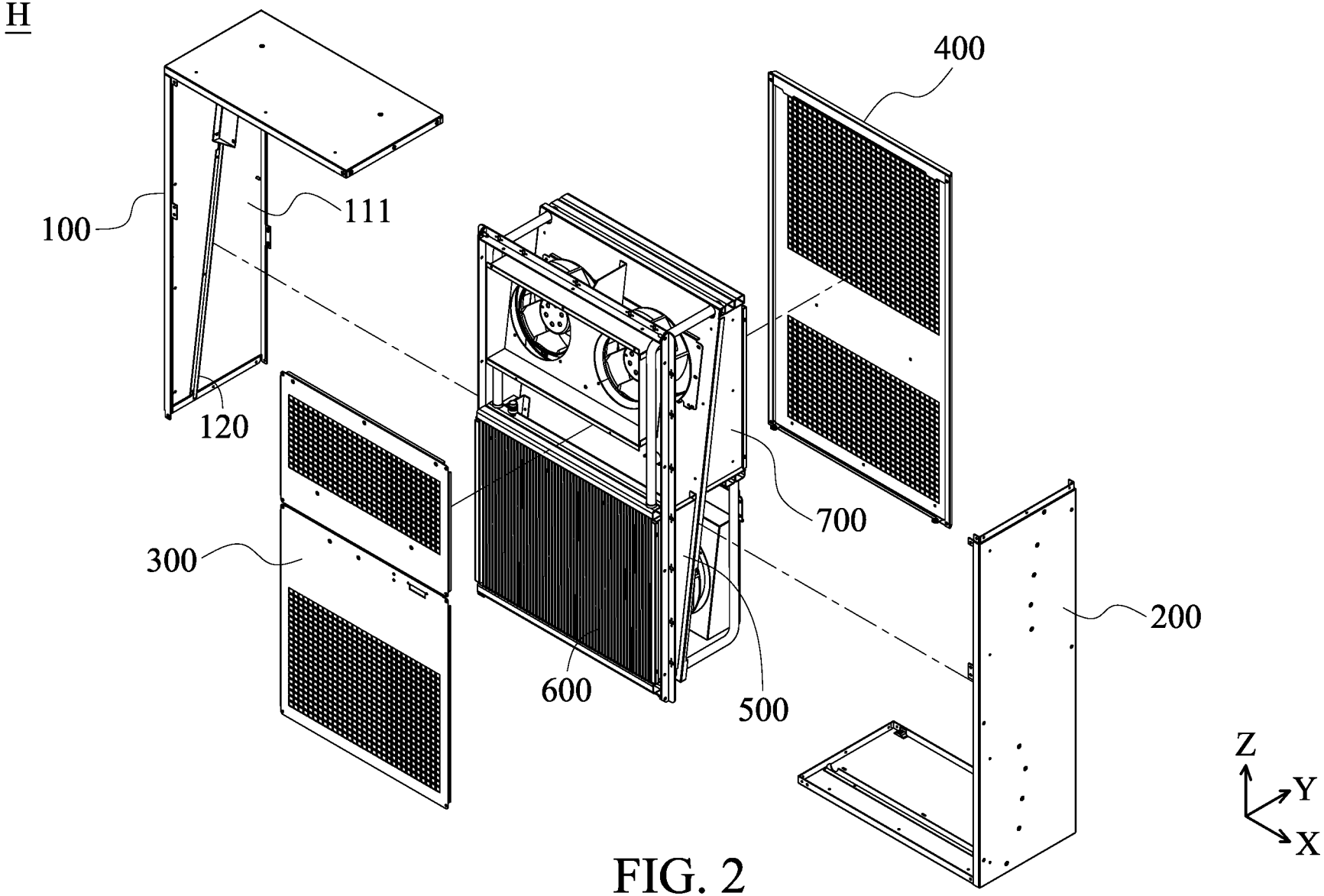
FIG. 2 is an exploded-view diagram of the heat exchanger according to an embodiment of the invention.

FIG. 1 is a schematic diagram of a heat exchanger H according to an embodiment of the invention, and FIG. 2 is an exploded-view diagram of the aforementioned heat exchanger H. As shown in FIG. 1 and FIG. 2, the heat exchanger H primarily includes a first case 100, a second case 200, a front cover plate 300, a rear cover plate 400, a substrate 500, an evaporator 600, and a condenser 700. The first case 100, the second case 200, the front cover plate 300, and the rear cover plate 400 can be assembled to form a box B. The substrate 500, the evaporator 600, and the condenser 700 can be accommodated in the inner space of the box B, wherein the substrate 500 can divide the inner space of the box B to be two separate regions.

Figure 3:
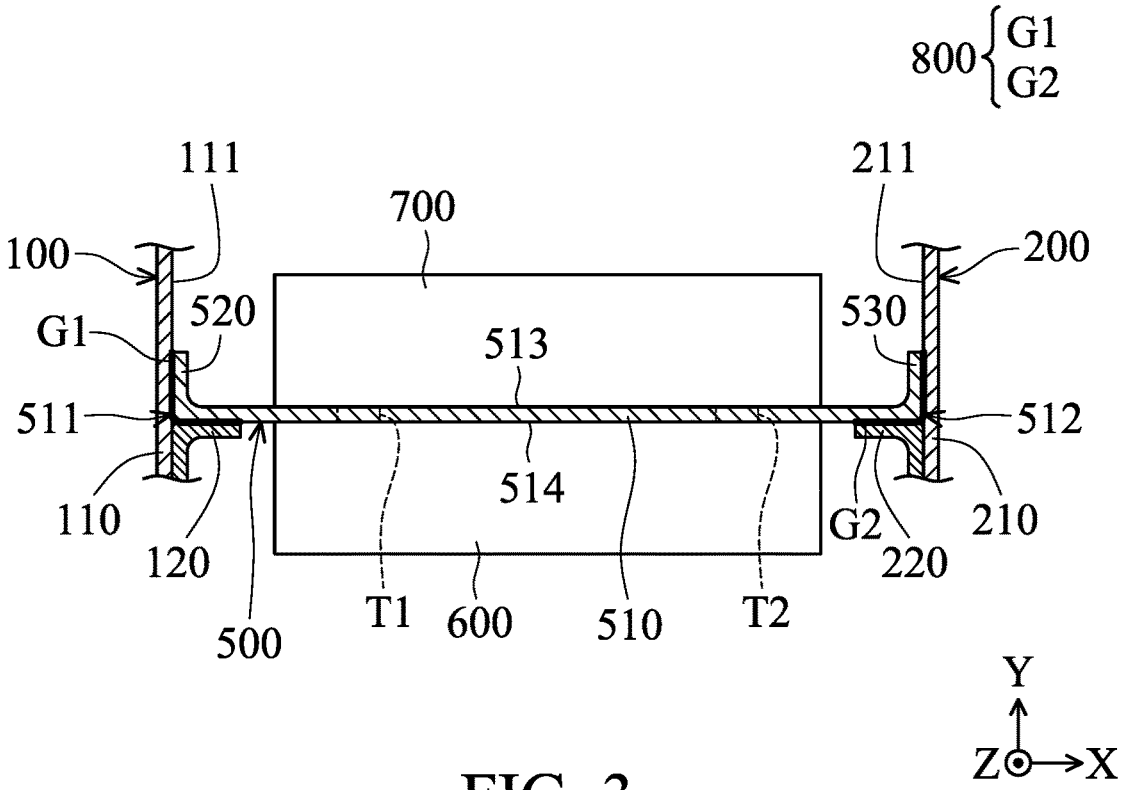
FIG. 3 is a partial cross-sectional view of the heat exchanger according to an embodiment of the invention.

As shown in FIG. 3, the first case 100 includes a first plate structure 110 and a first protruding structure 120. The first plate structure 110 has a first inner surface 111, and the first inner surface 111 faces the substrate 500. The first protruding structure 120 has a L-shaped appearance, and is disposed on the first inner surface 111 of the first plate structure 110. Thus, the first protruding structure 120 protrudes from the first inner surface 111 of the first plate structure 110. In some embodiments, the first plate structure 110 and the first protruding structure 120 are integrally formed as one piece.

The structure of the second case 200 is similar to the first case 100. The second case 200 includes a second plate structure 210 and a second protruding structure 220. The second plate structure 210 has a second inner surface 211, and the second inner surface 211 faces the substrate 500. The second protruding structure 220 has a L-shaped appearance, and is disposed on the second inner surface 211 of the second plate structure 210. Thus, the second protruding structure 220 protrudes from the second inner surface 211 of the second plate structure 210. In some embodiments, the second plate structure 210 and the second protruding structure 220 are integrally formed as one piece.

The substrate 500 is disposed between the first case 100 and the second case 200, and includes a plate 510, a first extending portion 520, and a second extending portion 530. The plate 510 is extended from the first inner surface 111 of the first plate structure 110 to the second inner surface 211 of the second plate structure 210, and has a first side 511, a second surface 512, a first surface 513, and the second surface 514. The first side 511 is opposite the second side 512, and the first surface 513 is opposite the second surface 514. In this embodiment, the first extending portion 520 is connected to the first side 511 of the plate 510 and extended in a direction away from the plate 510, and the second extending portion 530 is connected to the second side 512 of the plate 510 and extended in a direction away from the plate 510. Therefore, the substrate 500 substantially has a U-shaped appearance.

The substrate 500 can include waterproof material, such as polyethylene (PE), ethylene vinyl acetate (EVA), polyvinyl chloride (PVC), and/or a metal plate, but it is not limited thereto. Therefore, the fluid (for example, the steam) cannot pass through the substrate.

Referring to FIG. 3, when the heat exchanger H is assembled, the substrate 500 can be connected to the first case 100 and the second case 200 via an engaging structure 800. The substrate 500 is in contact with at least three different lateral surfaces of the engaging structure 800 so that the substrate 500 and the first case 100 combine are bonded. Moreover, the substrate 500 is in contact with at least three different surfaces of the engaging structure 800 so that the substrate 500 and the second case 200 combine are bonded. Owing to the aforementioned design, it can efficiently prevent the steam from pass the connecting portion of the substrate 500 and the first and second case 100 and 200, and the efficiency of the condensation and the evaporation and the heat dissipating performance of the heat exchanger H can be therefore enhanced.

For example, the engaging structure 800 can include waterproof glue G1 and waterproof glue G2. The first extending portion 520 can be affixed to the first inner surface 111 by the waterproof glue G1, and the second surface 514 of the plate 510 can be affixed to the first protruding structure 120 by the waterproof glue G1. In other words, a part of the waterproof glue G1 is disposed between the first extending portion 520 and the first inner surface 111, and another part of the waterproof glue G1 is disposed between the second surface 514 of the plate 510 and the first protruding structure 120. Therefore, the gap between the substrate 500 and the first case 100 can be sealed using waterproof glue G1, the fluid cannot flow between two separate regions in the box B through the gap between the substrate 500 and the first case 100. It should be noted that, since two engaging surfaces extending in different directions are formed between the substrate 500 and the first case 100, it can be ensured that two separate regions in the box B do not influenced each other, and the efficiency of the condensation and the evaporation can be enhanced.

The second extending portion 530 can be affixed to the second inner surface 211 by the waterproof glue G2, and the second surface 514 of the plate 510 can be affixed to the second protruding structure 220 by the waterproof glue G2. In other words, a part of the waterproof glue G2 is disposed between the second extending portion 530 and the second inner surface 211, and another part of the waterproof glue G2 is disposed between the second surface 514 of the plate 510 and the second protruding structure 220. Therefore, the gap between the substrate 500 and the second case 200 can be sealed using waterproof glue G2, the fluid cannot flow between two separate regions in the box B through the gap between the substrate 500 and the second case 200. Similarly, since two engaging surfaces extending in different directions are formed between the substrate 500 and the second case 200, it can be ensured that two separate regions in the box B do not influenced each other, and the efficiency of the condensation and the evaporation can be enhanced.

Figure 4:
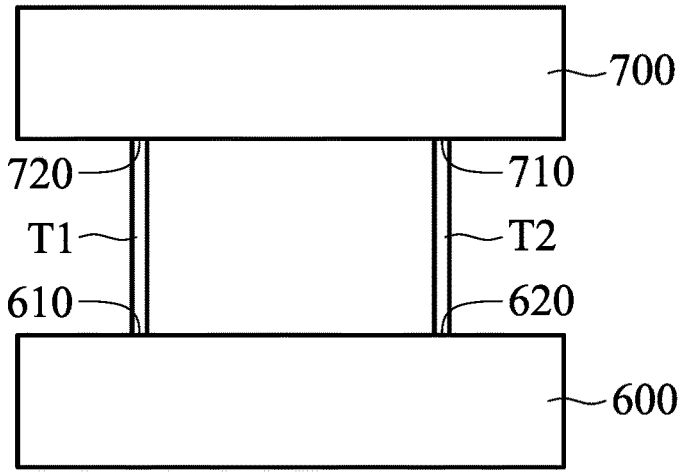
FIG. 4 is a schematic diagram of an evaporator, a condenser, a first tube, and a second tube according to an embodiment of the invention.

Referring to FIG. 2 to FIG. 4, the evaporator 600 and the condenser 700 are disposed on the substrate 500, and respectively accommodated in two separate regions in the box B. The evaporator 600 and the condenser 700 can be connected to each other by a first tube T1 and a second tube T2. In detail, the evaporator 600 has a first inlet structure 610 and a first outlet structure 620, and the condenser 700 has a second inlet structure 710 and a second outlet structure 720. The first tube T1 is connected to the first inlet structure 610 of the evaporator 600 and the second outlet structure 720 of the condenser 700, and the second tube T2 is connected to the first outlet structure 620 of the evaporator 600 and the second inlet structure 710 of the condenser 700.

Figure 5:
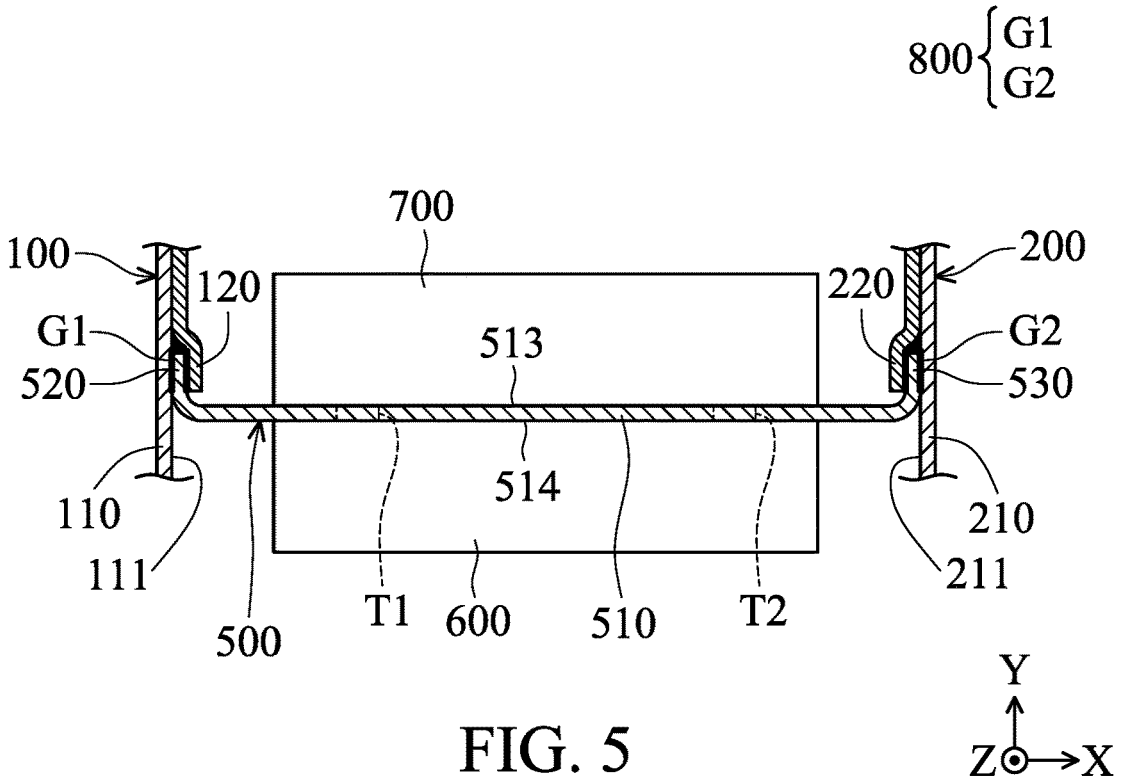
FIG. 5 is a schematic diagram of a heat exchanger according to another embodiment of the invention.

Referring to FIG. 5, in another embodiment of the invention, the first surface 513 of the substrate 500 faces the first protruding structure 120 of the first case 100 and the second protruding structure 220 of the second base 200, the first extending portion 520 is disposed between the first protruding structure 120 and the first inner surface 111, and the second extending portion 530 is disposed between the second protruding structure 220 and the second inner surface 211. The waterproof glue G1 fills the space between the first protruding structure 120 and the first inner surface 111, so that the waterproof glue G1 can surround the first extending portion 520, and connect the first extending portion 520 to the first protruding structure 120 and the first inner surface 111. Owing to the aforementioned arrangement, three engaging surfaces can be formed between the substrate 500 and the first case 100, and the waterproof properties and the efficiency of the condensation and the evaporation can be further enhanced.

Similarly, the space between the second protruding structure 220 and the second inner surface 211 is filled with waterproof glue G2, so that the waterproof glue G2 can surround the second extending portion 530, and connect the second extending portion 530 to the second protruding structure 220 and the second inner surface 211. Owing to the aforementioned arrangement, three engaging surfaces can be formed between the substrate 500 and the second case 200, and the waterproof properties and the efficiency of the condensation and the evaporation can be further enhanced.

Figure 6:
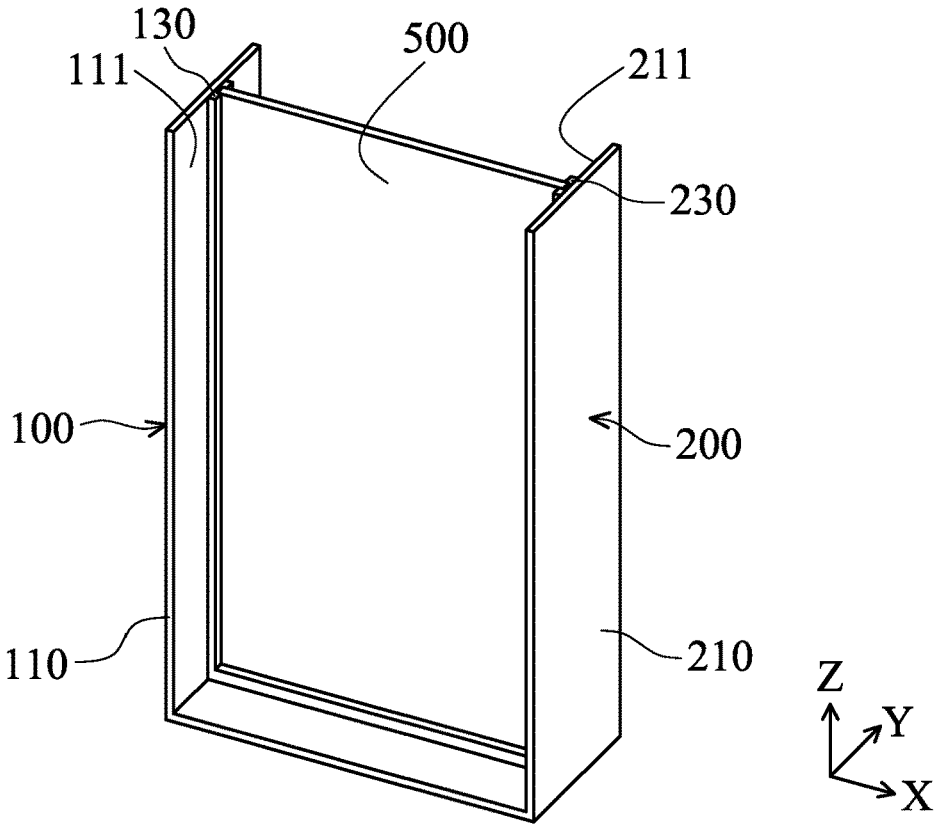
FIG. 6 is a schematic diagram of a first case, a second case, and a substrate according to another embodiment of the invention.
Figure 7:
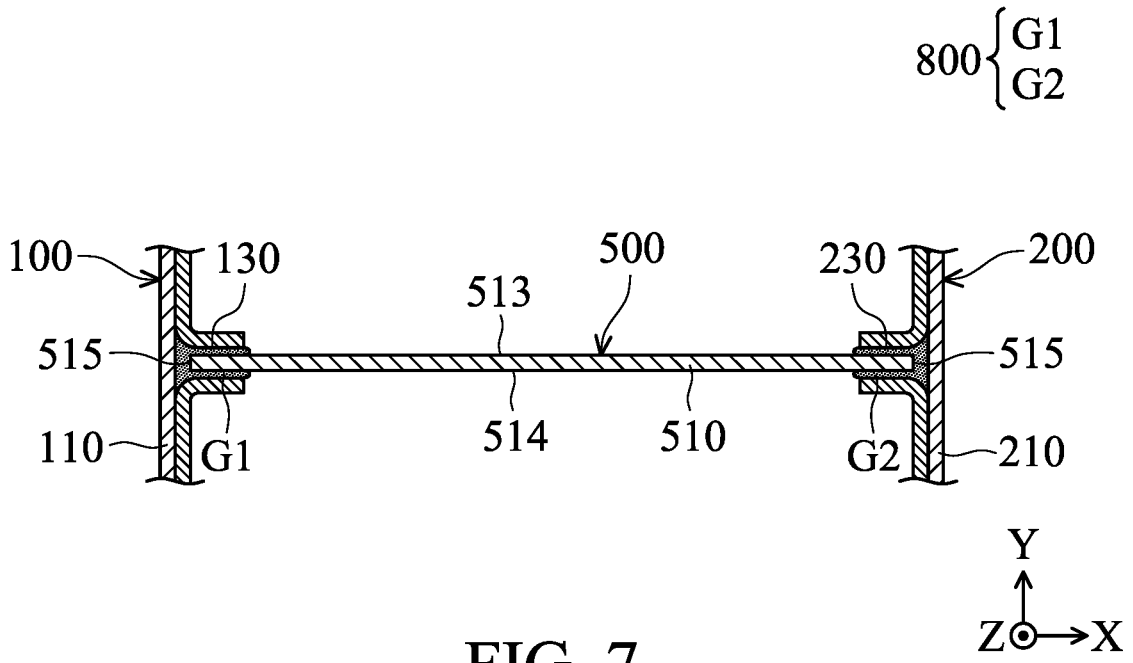
FIG. 7 is a schematic diagram of the first case, the second case, and the substrate according to another embodiment of the invention.

In another embodiment of the invention, the first case 100, the second case 200, and the substrate 500 of the heat exchanger H can be replaced by the first case 100, the second case 200, and the substrate 500 shown in FIG. 6 and FIG. 7. As shown in FIG. 6 and FIG. 7, the first case 100 can include a first plate structure 110 and a first recess 130, and the first recess 130 is situated on the first inner surface 111 of the first plate structure 110. The second case 200 can include a second plate structure 210 and a second recess 230, and the second recess 230 is situated on the second inner surface 211 of the second plate structure 210.

The substrate 500 has a plate appearance, and includes a first surface 513, a second surface 514, and a plurality of side surfaces 515, wherein the first surface 513 is opposite the second surface 514, and the side surfaces 515 are connected to the first surface 513 and the second surface 514. One side of the substrate 500 is accommodated in the first recess 130, and can be connected to the first case 100 by the waterproof glue G1 of the engaging structure 800. Specifically, the first recess 130 can be filled with waterproof glue G1 of the engaging structure 800, and can connect the first surface 513, the second surface 514, and at least one side surface 515 of the substrate 500 to the inner wall of the first recess 130.

Another side of the substrate 500 is accommodated in the second recess 230, and can be connected to the second case 200 by the waterproof glue G2 of the engaging structure 800. Specifically, the waterproof glue G2 of the engaging structure 800 can fill the second recess 230, and it can connect the first surface 513, the second surface 514, and at least one side surface 515 of the substrate 500 to the inner wall of the second recess 230.

Owing to the aforementioned arrangement, three engaging surfaces can be formed between the substrate 500 and the first case 100 and three engaging surfaces can be formed between the substrate 500 and the first case 100. The waterproof properties and the efficiency of the condensation and the evaporation can be efficiently enhanced. In this embodiment, the dimensions of the first recess 130 are substantially the same as that of the second recess 230, so as to facilitate the assembly and the affixation of the substrate 500.

Figure 8:
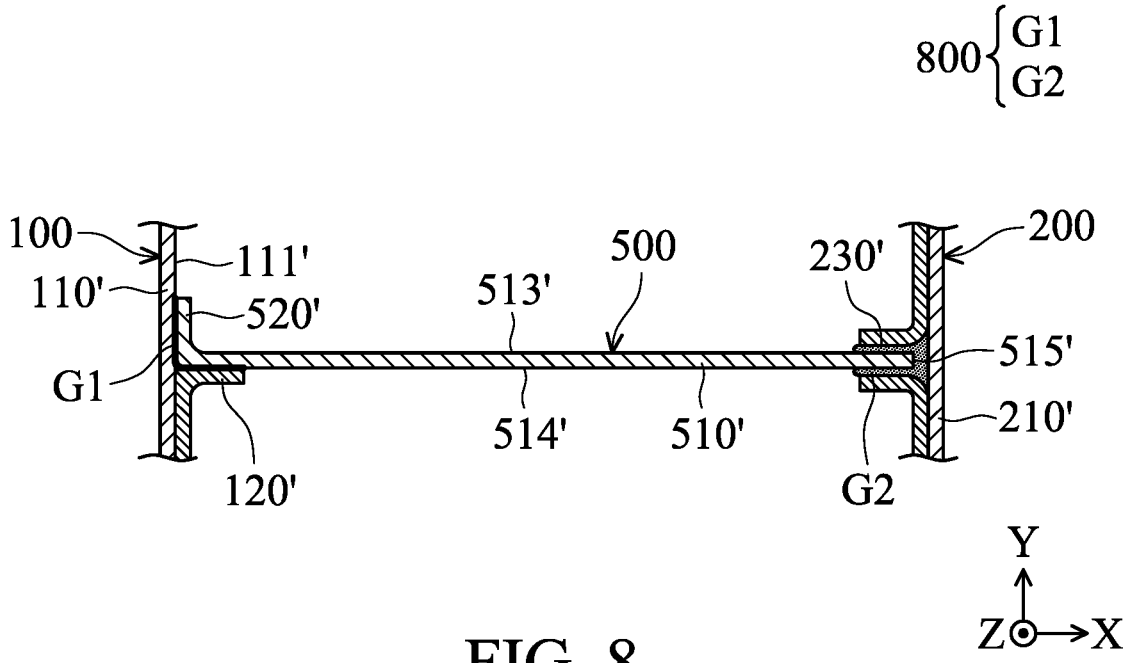
FIG. 8 is a schematic diagram of a first case, a second case, and a substrate according to another embodiment of the invention.

In another embodiment, the first case 100, the second case 200, and the substrate 500 of the heat exchanger H can be replaced by the first case 100, the second case 200, and the substrate 500 shown in FIG. 8. As shown in FIG. 8, the first case 100 can include a plate structure 110' and a protruding structure 120', the plate structure 110' has an inner surface 111', and the inner surface 111' faces the substrate 500. The protruding structure 120' has a L-shaped appearance, and is disposed on the inner surface 111' of the plate structure 110'. Therefore, the protruding structure 120' protrudes from the inner surface 111' of the plate structure 110'. In some embodiments, the plate structure 110' and the protruding structure 120' are integrally formed as one piece.

The second case 200 includes a plate structure 210' and a recess 230', and the recess 230' is situated on the plate structure 210'.

The substrate 500 is disposed between the first case 100 and the second case 200, and includes a plate 510' and an extending portion 520'. The plate 510' has a first surface 513' and a second surface 514', wherein the first surface 513' is opposite the second surface 514'. In this embodiment, the first extending portion 520' is connected to a side of the plate 510' and extended in a direction away from the plate 510', The extending portion 520' can be affixed to the inner surface 111' by the waterproof glue G1 of the engaging structure 800, and the second surface 514' of the plate 510' can be affixed to the protruding structure 120' by the waterproof glue G1. In other words, a part of the waterproof glue G1 is disposed between the extending portion 520' and the inner surface 111', and another part of the waterproof glue G1 is disposed between the second surface 514' of the plate 510' and the protruding structure 120'. Therefore, the gap between the substrate 500 and the first case 100 can be sealed using waterproof glue G1, the fluid cannot flow between two separate regions in the box B through the gap between the substrate 500 and the first case 100. Since two engaging surfaces extending in different directions are formed between the substrate 500 and the first case 100, it can be ensured that two separate regions in the box B do not influenced each other, and the efficiency of the condensation and the evaporation can be enhanced.

A side of the plate 510' that is not connected to the extending portion 520' can be accommodated in the recess 230', and can be connected to the second case 200 by the waterproof glue G2 of the engaging structure 800. Specifically, the side of the plate 510' that is not connected to the extending portion 520' has a side surface 515'. The waterproof glue G2 of the engaging structure 800 can fill the recess 230', and it can connect the first surface 513', the second surface 514', and the side surface 515' of the substrate 500 to the inner wall of the second recess 230'. Owing to the aforementioned arrangement, three engaging surfaces can be formed between the substrate 500 and the second case 200, and the waterproof properties and the efficiency of the condensation and the evaporation can be efficiently enhanced.

Figure 9:
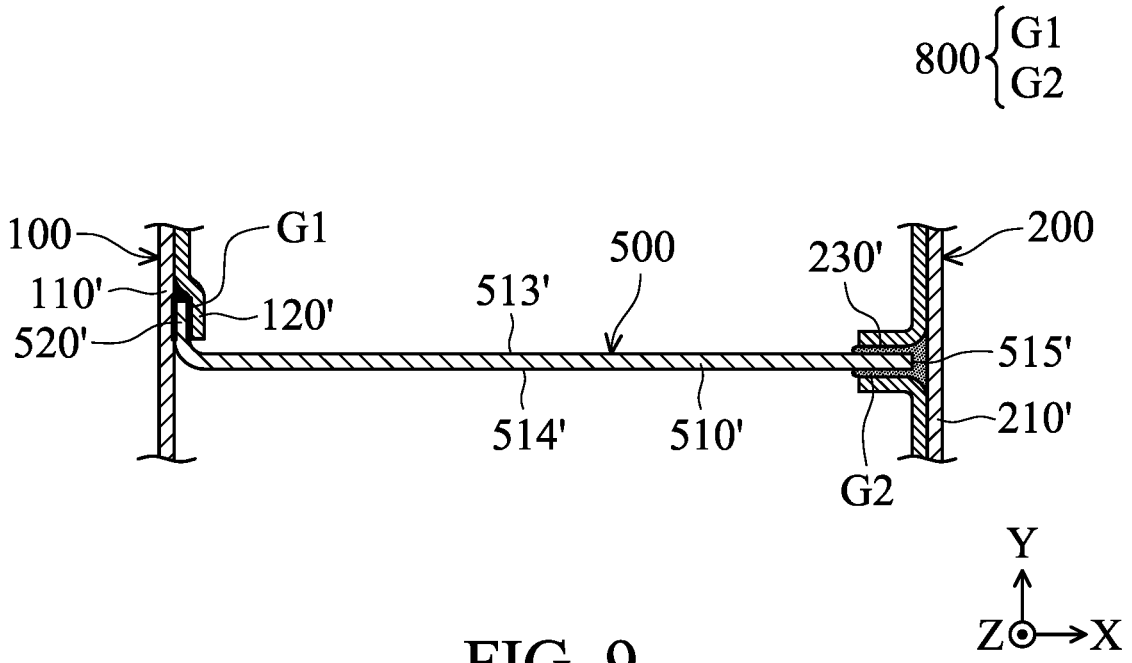
FIG. 9 is a schematic diagram of a first case, a second case, and a substrate according to another embodiment of the invention.

In another embodiment, the first case 100, the second case 200, and the substrate 500 of the heat exchanger H can be replaced by the first case 100, the second case 200, and the substrate 500 shown in FIG. 9. The embodiment of FIG. 9 is different from the embodiment of FIG. 8 in that the first surface 513' of the substrate 500 faces the protruding structure 120' of the first case 100, and the extending portion 520' is disposed between the protruding structure 120' and the inner surface 111'. The space between the protruding structure 120' and the inner surface 111' can be filled with waterproof glue G1, so that the waterproof glue G1 can enclose the extending portion 520' and connect the extending portion 520' to the protruding structure 120' and the inner surface 111'. Owing to the aforementioned arrangement, three engaging surfaces can be formed between the substrate 500 and the first case 100, and the waterproof properties and the efficiency of the condensation and the evaporation can be further enhanced.

In summary, an embodiment of the invention provides a heat exchanger, including a first case, a second case, a substrate, an engaging structure, an evaporator, a condenser, a first tube, and a second tube. The first case includes a first plate structure and a first protruding structure. The first plate structure has a first inner surface. The first protruding structure protrudes from the first inner surface. The second case includes a second plate structure and a second protruding structure. The second plate structure has a second inner surface. The second protruding structure protrudes from the second inner surface. The substrate is disposed between the first case and the second case and corresponds to the first protruding structure and the second protruding structure. The substrate is in contact with at least three different lateral surfaces of the engaging structure so that the substrate and the first case combine are bonded. The substrate is engaged with the first inner surface, the first protruding structure, the second inner surface, and the second protruding structure via the engaging structure. The evaporator and the condenser are disposed on the substrate, and the substrate is disposed between the evaporator and the condenser. The evaporator has a first inlet structure and a first outlet structure, and the condenser has a second inlet structure and a second outlet structure. The first tube is connected to the first inlet structure and the second outlet structure. The second tube is connected to the first outlet structure and second inlet structure.

An embodiment of the invention also provides a heat exchanger, including a first case, a second case, a substrate, an engaging structure, an evaporator, a condenser, a first tube, and a second tube. The first case includes a first recess, and the second case includes a second recess. The substrate is situated between the first case and the second case, and accommodated in the first recess and the second recess. The engaging structure is connected to the substrate and the inner wall of the first recess and the inner wall of the second recess. The substrate is in contact with at least three different lateral surfaces of the engaging structure so that the substrate and the first case combine are bonded. The evaporator and the condenser are disposed on the substrate, and the substrate is disposed between the evaporator and the condenser. The evaporator has a first inlet structure and a first outlet structure, and the condenser has a second inlet structure and a second outlet structure. The first tube is connected to the first inlet structure and the second outlet structure. The second tube is connected to the first outlet structure and second inlet structure.

An embodiment of the invention further provides a heat exchanger, including a first case, a second case, a substrate, an engaging structure, an evaporator, a condenser, a first tube, and a second tube. The first case includes a plate structure and a protruding structure. The plate structure has an inner surface, and the protruding structure protrudes from the inner surface. The second case includes a recess. The substrate is disposed between the first case and the second case and corresponds to the protruding structure and the recess. The substrate is engaged with the inner surface, the protruding structure, and the inner wall of the recess via the engaging structure. The substrate is in contact with at least three different lateral surfaces of the engaging structure so that the substrate and the first case combine are bonded. The evaporator and the condenser are disposed on the substrate, and the substrate is disposed between the evaporator and the condenser. The evaporator has a first inlet structure and a first outlet structure, and the condenser has a second inlet structure and a second outlet structure. The first tube is connected to the first inlet structure and the second outlet structure. The second tube is connected to the first outlet structure and second inlet structure.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A heat exchanger, comprising:

a first case, comprising a first plate structure and a first protruding structure, wherein the first plate structure comprises a first inner surface, the first protruding structure protrudes from the first inner surface, and a longitudinal axis of the first protruding structure is extended from a top side to a bottom side of the first case;

a second case, comprising a second plate structure and a second protruding structure, wherein the second plate structure comprises a second inner surface, the second protruding structure protrudes from the second inner surface, and a longitudinal axis of the second protruding structure is extended from a top side to a bottom side of the second case;

a substrate, disposed between the first case and the second case and corresponding to the first protruding structure and the second protruding structure;

an engaging structure, wherein the substrate is engaged with the first inner surface, the first protruding structure, the second inner surface, and the second protruding structure via the engaging structure, and the substrate is in contact with at least three different lateral surfaces of the engaging structure so that the substrate and the first case combine are bonded;

an evaporator, disposed on the substrate and having a first inlet structure and a first outlet structure;

a condenser, disposed on the substrate and having a second inlet structure and a second outlet structure, wherein the substrate is disposed between the evaporator and the condenser;

a first tube, connected to the first inlet structure and the second outlet structure; and a second tube, connected to the first outlet structure and the second inlet structure.

2. The heat exchanger as claimed in claim 1, wherein the substrate comprises:

a plate, having a first side and a second side opposite the first side;

a first extending portion, connected to the first side, and extending in a direction away from the first side; and a second extending portion, connected to the second side, and extending in a direction away from the second side, wherein a part of the engaging structure is disposed between the first extending portion and the first inner surface, and another part of the engaging structure is disposed between the second extending portion and the second inner surface.

3. The heat exchanger as claimed in claim 2, wherein the plate has a first surface and a second surface, the first extending portion protrudes from the first surface, the second surface is opposite the first surface and faces the first protruding structure, and a part of the engaging structure is disposed between the second surface and the first protruding structure.

4. The heat exchanger as claimed in claim 2, wherein the first extending portion is disposed between the first protruding structure and the first inner surface.

5. The heat exchanger as claimed in claim 4, wherein the engaging structure surrounds the first extending portion.

6. The heat exchanger as claimed in claim 2, wherein the first extending portion and the second extending portion extend in the same direction.

7. The heat exchanger as claimed in claim 1, wherein the engaging structure comprises a waterproof glue.

8. The heat exchanger as claimed in claim 1, wherein the substrate is in contact with at least three different lateral surfaces of the engaging structure so that the substrate and the second case combine are bonded.

* * * * *